US005408757A

United States Patent [19]

Lenz

[11] Patent Number: 5,408,757

[45] Date of Patent: Apr. 25, 1995

[54] JIG FOR INSTALLING LAP SIDING

[76] Inventor: Mike R. Lenz, 4337 SE. 79th Ave., Portland, Oreg. 97206

[21] Appl. No.: 237,163

[22] Filed: May 3, 1994

[51] Int. Cl.[6] ..... G01D 21/00

[52] U.S. Cl. ..... 33/647

[58] Field of Search ..... 33/646, 647, 648, 649, 33/411; 52/547, 548

[56] References Cited

U.S. PATENT DOCUMENTS

| | | | |
|---|---|---|---|
| 368,574 | 8/1887 | Eby | 33/647 |
| 572,582 | 12/1896 | Stevenson . | |
| 4,208,799 | 6/1980 | Frantello | 33/187 |
| 4,425,714 | 1/1984 | Kelly | 33/187 |
| 4,473,100 | 9/1984 | Wheeler | 145/1 B |
| 4,484,392 | 11/1984 | Defino | 33/187 |
| 4,899,459 | 2/1990 | Taggart | 33/646 |

*Primary Examiner*—Thomas B. Will
*Attorney, Agent, or Firm*—Eugene M. Eckelman

[57] ABSTRACT

A vertical body member has a slot leading down from the upper end thereof for receiving and supporting a piece of siding to be installed. The slot has a depth that determines the overlap of a piece of siding and is defined at the rear by a wall terminating in its upper end in a rearwardly turned hook portion that can hook over the top edge of an installed piece of siding for supporting the body member and a piece of siding to be installed. The hook portion has a selected rigidity such that it will support a piece of siding that is being installed but also has a resilience that allows it to straighten out when the body member is pulled forcefully downwardly whereby the rear wall and hook portion can be slid out from between a previously installed piece of siding and a piece of siding just installed. The hook portion has memory characteristics such that it will reassume its hook shape after being removed from between the siding pieces.

5 Claims, 2 Drawing Sheets

JIG FOR INSTALLING LAP SIDING

BACKGROUND OF THE INVENTION

This invention relates to a new and useful device that assists in installing lap siding.

Lap siding is a common type of siding wherein siding pieces partially overlap the siding piece directly below it. The amount of overlap is generally quite universal although it can vary in some circumstances. Devices have heretofore been conceived that support a strip of siding on the lower strip in proper or desired overlap. Most of these devices hook over the top edge of the lower strip of siding for supporting a piece of siding to be installed. The hook portion thus is trapped between the two pieces of siding. In order to remove this hook portion, some prior devices slide the unit out an end of the siding. This manner of removing the device is not always possible and is often impractical. U.S. Pat. No. 572,582 and 4,208,799 show this type of device.

Other devices are used as well but most of them are complicated and expensive to manufacture. Such devices are shown in U.S. Pat. Nos. 4,425,714, 4,473,100 and 4,484,392. In these prior structures it is necessary to separate the siding pieces slightly for clearing the hook portion from between the two siding pieces. This is difficult to do and may damage the siding.

SUMMARY OF THE INVENTION

An object of the invention is to provide a siding jig with important improvements over prior devices, namely, it is simplified in its structure, it is inexpensive to manufacture, and it is efficient in use, particularly in its function of being removed from between two pieces of siding.

In carrying out the objects of the invention, the device of the invention comprises a vertical body member with a slot leading down from the upper end for receiving and supporting a piece of siding to be installed. The slot has a depth that determines the overlap of a piece of siding when a piece of siding is laid edgewise therein. The slot is defined at the rear by a wall terminating at its upper end in a rearwardly turned hook portion that hooks over the top edge of an installed piece of siding and supports a piece of siding to be installed. The hook portion has a selected strength such that it will adequately support the weight of a piece of siding that is being installed and also has a resilience that allows it to straighten out when the body member is pulled forcefully downwardly to slide the rear wall out from between the previously installed piece of siding and a piece of siding just installed. This hook portion has memory characteristics whereby automatically to reassume its hook shape after being pulled free of the siding.

The invention will be better understood and additional objects will become apparent from the following description taken in connection with the accompanying drawing.

DETAILED DESCRIPTION OF A PREFERRED EMBODIMENT

Figure 2:
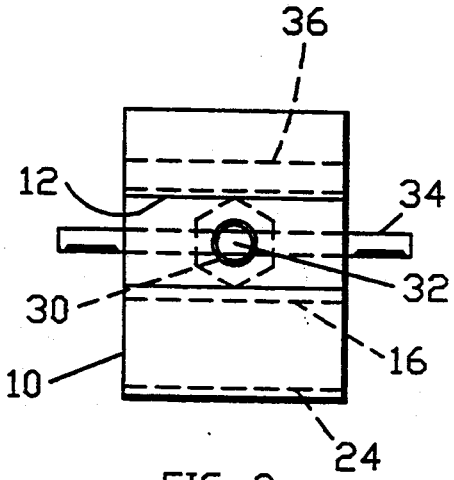
FIG. 2 is a top plan view reversely turned from that of FIG. 1.
Figure 1:
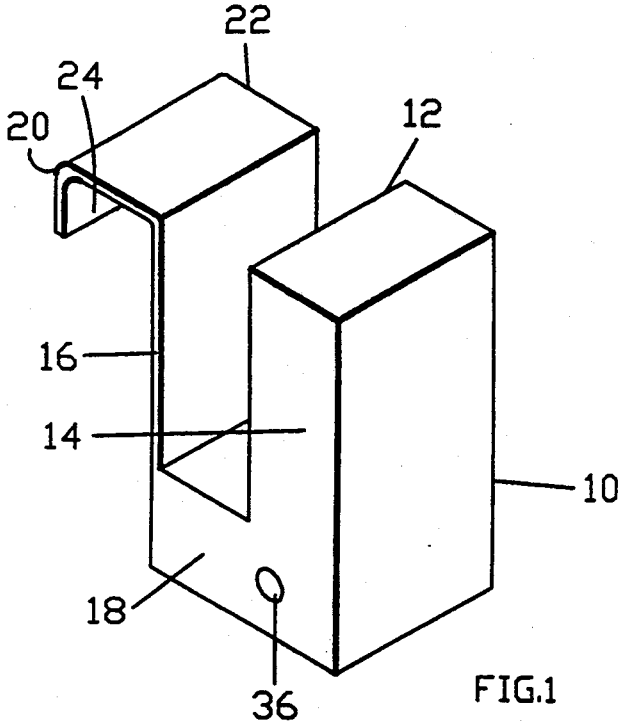
FIG. 1 is a perspective view of the jig of the invention.
Figure 3:
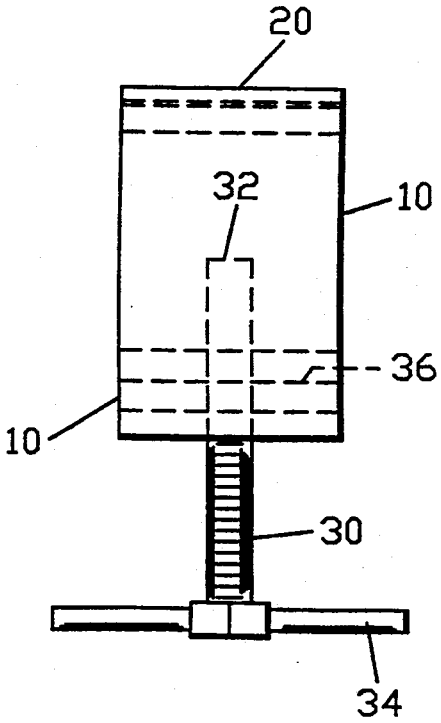
FIG. 3 is a front elevational view.
Figure 4:
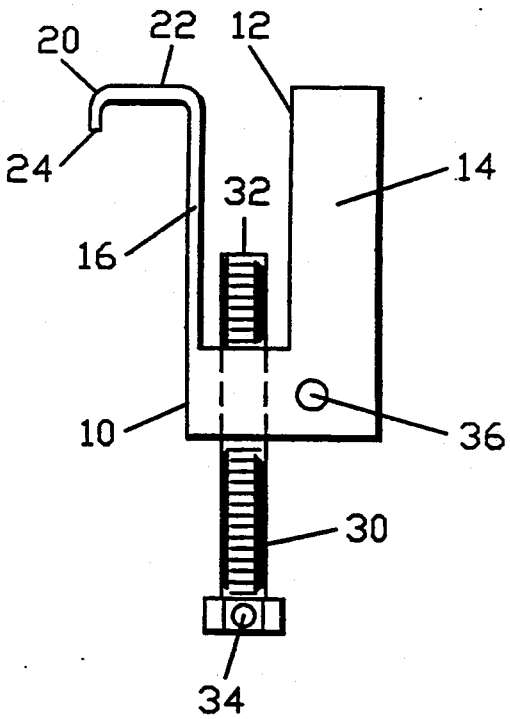
FIG. 4 is a side elevational view.

Referring particularly to the drawings, the jig of the invention comprises a vertical body portion 10 having a top opening slot 12 therein defined by a front, sturdy thickened wall 14. The rear of the slot is defined by a thin wall 16. The bottom portion of the body member comprises a sturdy wall 18. Slot 12 opens through the sides of the body member and is of a front to rear dimension that will freely receive a piece of siding edgewise therein.

The top of rear wall 16 terminates in a rearwardly turned hook portion 20 having a horizontal top wall 22 and a short depending vertical extension 24 at the end of the hook. The body member and hook portion is of an overall sturdy or rigid structure such that the hook portion 20, when engaged with the top edge of one piece of siding, will support a piece of siding that is supported edgewise in the slot 12. Also, the hook portion has a resilience that allows it to straighten out when forced through a narrow space. Further, the device is constructed of a material such as plastic that has memory characteristics wherein when the hook portion is straightened out in substantially linear relationship with the wall 16, it will immediately return to its original hook shape. The characteristics of the resilience and memory of the plastic or other material used, as to permit temporary distortion of the hook and yet to maintain a strength in the wall 16 and hook sufficient to support the weight of a piece of siding, are determined by the specifications of the material used and the thickness. The material used must provide substantially thin construction of the back wall 16 and hook so as to maintain minimum spacing between two overlapped pieces of siding. For the application of normal size of siding, it is preferred that the thickness of these parts does not exceed $\frac{1}{8}$th inch.

The body member 12 has an adjusting screw 30 threadedly mounted vertically in the bottom wall 18 and projecting up into the slot 12. The end of the screw has a flat surface 32 to serve as an abutment for the piece of siding being installed and controls the amount of overlap of siding.

Figure 5:
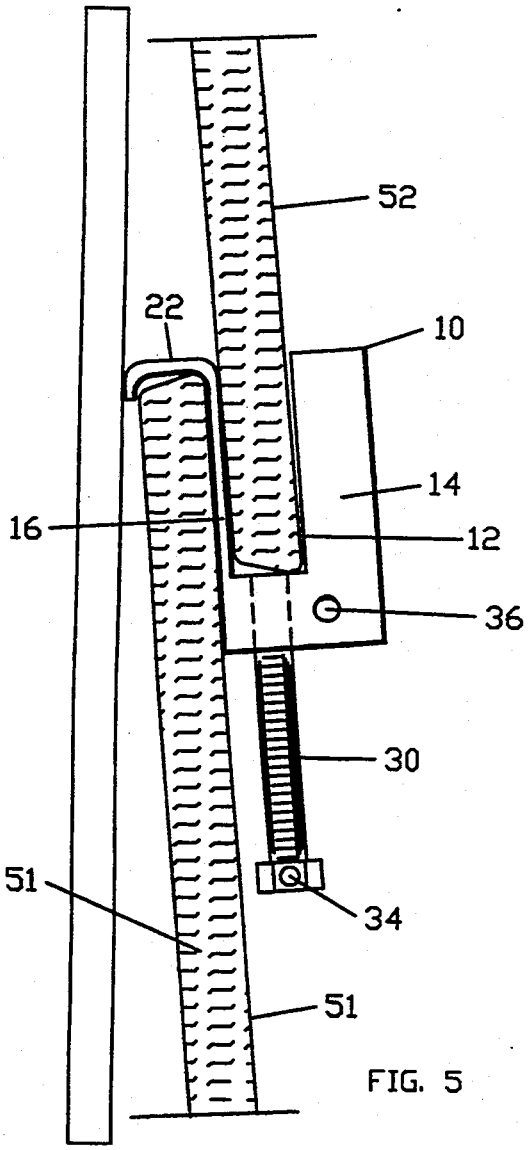
FIGS. 5 and 6 are side elevational views showing the present invention in the process of installing siding.
Figure 6:
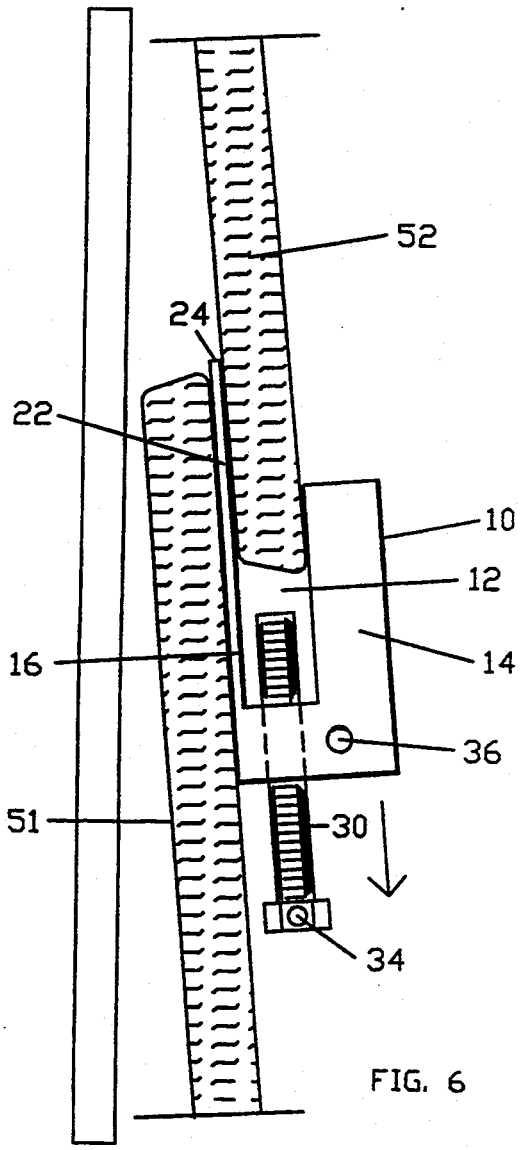

In the installation of siding, FIGS. 5 and 6, a first piece of siding 51 is installed at the bottom of the wall in a conventional manner. The present jig is used for siding pieces 52 installed above this first piece. When installing a next above piece of siding, the jig is mounted on the installed piece by engaging the hook portion 20 with the top edge of the already installed piece of siding. Any number of the jigs can be used along the piece 51. The piece of siding 52 is then placed edgewise in the slot 12. This supports the siding 52 in one or more places as desired. Siding piece 52 can then be nailed in place with its proper overlap.

Thereupon, the jig is removed by forcefully pulling it downwardly, as shown by the arrow in FIG. 6. This forceful downward pull straightens out the hook portion 20 into linear relation with the thin back wall 16 and the jig will readily slip out between the two siding pieces. As soon as the jig is removed, the hook portion, with its memory characteristics, will again assume the hook shape and the jig is ready to be used on the next piece of siding. The head portion of the adjusting screw has a lateral handle 34 which assists in adjusting the screw and also in getting a grip on the jig to forcefully pull it out from between two pieces of siding. Also, if desired, the body member may have a lateral bore 36 through which a pull line can be tied for pulling the jig out.

The structure of the present jig provides quick removal from between the siding pieces and greatly speeds up the application of the siding. One person can install siding accurately by using two or more of the present jigs along the length of the installed siding. Adjustment of the screw 20 is used to determine the amount of overlap.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. A reusable siding jig for assisting carpenters in installing pieces of lap siding on a building comprising:

a body member, and a slot leading down from the upper end of said body member and extending laterally therethrough for receiving and supporting a piece of siding to be installed, said slot including bottom seat means that determines a desired overlap of a piece of siding when the piece of siding is laid edgewise therein, said slot being defined at the rear thereof by a wall terminating at its upper end in a rearwardly turned hook portion that can hook over the top edge of a previously installed piece of siding for supporting a piece of siding to be installed with said rear wall extending up between the previously installed piece of siding and a piece of siding being installed, said hook portion having a selected rigidity such that when hooked over the top edge of an installed piece of siding it will support a piece of siding in said slot which is being installed, said hook portion also having a resilience that allows it to straighten out when the body portion is pulled forcefully downwardly to cause the rear wall to slide out from between a previously installed piece of siding and a piece of siding just installed, said hook portion being constructed of a material with memory characteristics such that said hook portion will automatically reassume a hook shape after having been straightened out by the forceful removal of said body portion from between pieces of siding.

2. The siding Jig of claim 1 including an adjustable screw member projecting upwardly from the bottom of the body portion and into the slot, said screw member having an upper end that forms said bottom seat means for adjusting an overlap amount of support for a piece supported in said slot.

3. The siding jig of claim 2 wherein a portion of said screw member projects downwardly through the bottom of said body member to serve as a gripping handle for forcefully pulling the hook portion out from between the siding pieces.

4. The siding jig of claim 1 wherein said body member includes means for fastening a pull line to said body member for forcefully pulling the hook portion out from between the siding pieces.

5. A reusable siding Jig for assisting carpenters in installing lap siding on a building comprising:

a molded body member, and a slot leading down from the upper end of said body member and extending laterally therethrough for receiving and supporting a piece of siding to be installed, said slot including bottom seat means that determines a desired overlap of a piece of siding when the piece of siding is laid edgewise therein, said slot being defined at the rear thereof by a wall terminating at its upper end in a rearwardly turned hook portion that can hook over the top edge of a previously installed piece of siding for supporting a piece of siding to be installed with said rear wall extending up between the previously installed piece of siding and a piece of siding being installed, said rear wall being molded as an integral part of said body member, said hook portion having a selected rigidity such that when hooked over the top edge of an installed piece of siding it will support a piece of siding in said slot which is being installed, said hook portion also having a resilience that allows it to straighten out when the body portion is pulled forcefully downwardly to cause the rear wall to slide out from between a previously installed piece of siding and a piece of siding just installed, said hook portion being constructed of a material with memory characteristics such that said hook portion will automatically reassume a hook shape after having been straightened out by the forceful removal of said body portion from between pieces of siding.

* * * * *